US007182849B2

(12) United States Patent
Shih et al.

(10) Patent No.: US 7,182,849 B2
(45) Date of Patent: Feb. 27, 2007

(54) ECP POLYMER ADDITIVES AND METHOD FOR REDUCING OVERBURDEN AND DEFECTS

(75) Inventors: Chien-Hsueh Shih, Taipei (TW); Shaulin Shue, Hsinchu (TW)

(73) Assignee: Taiwan Semiconducotr Manufacturing Co., Ltd., Hsinchu (TW)

( * ) Notice: Subject to any disclaimer, the term of this patent is extended or adjusted under 35 U.S.C. 154(b) by 131 days.

(21) Appl. No.: 10/788,571

(22) Filed: Feb. 27, 2004

(65) Prior Publication Data

US 2005/0189233 A1 Sep. 1, 2005

(51) Int. Cl.
*C25D 3/00* (2006.01)
*C25D 3/56* (2006.01)

(52) U.S. Cl. ..... 205/261; 205/238

(58) Field of Classification Search ..... 205/238, 205/261

See application file for complete search history.

(56) References Cited

U.S. PATENT DOCUMENTS 4,468,291 A * 8/1984 Naarmann et al. ..... 205/77
5,527,434 A * 6/1996 Hamnett et al. ..... 205/331

FOREIGN PATENT DOCUMENTS

JP 60017092 A * 1/1985

* cited by examiner

*Primary Examiner*—Edna Wong
(74) *Attorney, Agent, or Firm*—Thomas, Kayden, Horstemeyer & Risley

(57) ABSTRACT

Electrochemical plating polymer additives and method which reduces metal overburden in an electroplated metal while optimizing gap fill capability are disclosed. The polymer additives are provided in an electrochemical plating bath solution and may include low cationic charge density co-polymers having aromatic and amine functional group monomers. The low cationic charge density polymers may include benzene or pyrollidone functional group monomers and imidazole or imidazole derivative functional group monomers.

16 Claims, 1 Drawing Sheet

ECP POLYMER ADDITIVES AND METHOD FOR REDUCING OVERBURDEN AND DEFECTS

FIELD OF THE INVENTION

The present invention relates to electrochemical plating (ECP) processes used to deposit metal layers on semiconductor wafer substrates in the fabrication of semiconductor integrated circuits. More particularly, the present invention relates to ECP polymer additives and a method for reducing overburden and defects in the electrochemical plating of metals, particularly copper, on a substrate.

BACKGROUND OF THE INVENTION

In the fabrication of semiconductor integrated circuits, metal conductor lines are used to interconnect the multiple components in device circuits on a semiconductor wafer. A general process used in the deposition of metal conductor line patterns on semiconductor wafers includes deposition of a conducting layer on the silicon wafer substrate; formation of a photoresist or other mask such as titanium oxide or silicon oxide, in the form of the desired metal conductor line pattern, using standard lithographic techniques; subjecting the wafer substrate to a dry etching process to remove the conducting layer from the areas not covered by the mask, thereby leaving the metal layer in the form of the masked conductor line pattern; and removing the mask layer typically using reactive plasma and chlorine gas, thereby exposing the top surface of the metal conductor lines. Typically, multiple alternating layers of electrically conductive and insulative materials are sequentially deposited on the wafer substrate, and conductive layers at different levels on the wafer may be electrically connected to each other by etching vias, or openings, in the insulative layers and filling the vias using aluminum, tungsten or other metal to establish electrical connection between the conductive layers.

Deposition of conductive layers on the wafer substrate can be carried out using any of a variety of techniques. These include oxidation, LPCVD (low-pressure chemical vapor deposition), APCVD (atmospheric-pressure chemical vapor deposition), and PECVD (plasma-enhanced chemical vapor deposition). In general, chemical vapor deposition involves reacting vapor-phase chemicals that contain the required deposition constituents with each other to form a nonvolatile film on the wafer substrate. Chemical vapor deposition is the most widely-used method of depositing films on wafer substrates in the fabrication of integrated circuits on the substrates.

Due to the ever-decreasing size of semiconductor components and the ever-increasing density of integrated circuits on a wafer, the complexity of interconnecting the components in the circuits requires that the fabrication processes used to define the metal conductor line interconnect patterns be subjected to precise dimensional control. Advances in lithography and masking techniques and dry etching processes, such as RIE (Reactive Ion Etching) and other plasma etching processes, allow production of conducting patterns with widths and spacings in the submicron range. Electrodeposition or electroplating of metals on wafer substrates has recently been identified as a promising technique for depositing conductive layers on the substrates in the manufacture of integrated circuits and flat panel displays. Such electrodeposition processes have been used to achieve deposition of the copper or other metal layer with a smooth, level or uniform top surface. Consequently, much effort is currently focused on the design of electroplating hardware and chemistry to achieve high-quality films or layers which are uniform across the entire surface of the substrates and which are capable of filling or conforming to very small device features. Copper has been found to be particularly advantageous as an electroplating metal.

Electroplated copper provides several advantages over electroplated aluminum when used in integrated circuit (IC) applications. Copper is less electrically resistive than aluminum and is thus capable of higher frequencies of operation. Furthermore, copper is more resistant to electromigration (EM) than is aluminum. This provides an overall enhancement in the reliability of semiconductor devices because circuits which have higher current densities and/or lower resistance to EM have a tendency to develop voids or open circuits in their metallic interconnects. These voids or open circuits may cause device failure or burn-in.

A typical standard or conventional electroplating system for depositing a metal such as copper onto a semiconductor wafer includes a standard electroplating cell having an adjustable current source, a bath container which holds an electrolyte electroplating bath solution (typically acid copper sulfate solution), and a copper anode and a cathode immersed in the electrolyte solution. The cathode is the semiconductor wafer that is to be electroplated with metal. Both the anode and the semiconductor wafer/cathode are connected to the current source by means of suitable wiring. The electroplating bath solution may include an additive for filling of submicron features and leveling the surface of the copper electroplated on the wafer. An electrolyte holding tank may further be connected to the bath container for the addition of extra electrolyte solution to the bath container, as needed.

In operation of the electroplating system, the current source applies a selected voltage potential typically at room temperature between the anode and the cathode/wafer. This potential creates a magnetic field around the anode and the cathode/wafer, which magnetic field affects the distribution of the copper ions in the bath. In a typical copper electroplating application, a voltage potential of about 2 volts may be applied for about 2 minutes, and a current of about 4.5 amps flows between the anode and the cathode/wafer. Consequently, copper is oxidized at the anode as electrons from the copper anode and reduce the ionic copper in the copper sulfate solution bath to form a copper electroplate at the interface between the cathode/wafer and the copper sulfate bath.

The copper oxidation reaction which takes place at the anode is illustrated by the following reaction equation:

$$Cu \rightarrow Cu^{++} + 2e^{-}$$

The oxidized copper cation reaction product forms ionic copper sulfate in solution with the sulfate anion in the bath 20:

$$Cu^{++} + SO_4^{--} \rightarrow Cu^{++}SO_4^{--}$$

At the cathode/wafer, the electrons harvested from the anode flowed through the wiring reduce copper cations in solution in the copper sulfate bath to electroplate the reduced copper onto the cathode/wafer:

$$Cu^{++} + 2e^{-} \rightarrow Cu$$

After the copper is electroplated onto the wafer, the wafer is frequently subjected to a CMP (chemical mechanical polishing) process to remove excess copper (copper overburden) from the electroplated copper layer and smooth the surface of the layer. Important components used in CMP processes include an automated rotating polishing platen and a wafer holder, which both exert a pressure on the wafer and rotate the wafer independently of the platen. The polishing or removal of surface layers is accomplished by a polishing slurry consisting mainly of colloidal silica suspended in deionized water or KOH solution. The slurry is frequently fed by an automatic slurry feeding system in order to ensure uniform wetting of the polishing pad and proper delivery and recovery of the slurry. For a high-volume wafer fabrication process, automated wafer loading/unloading and a cassette handler are also included in a CMP apparatus.

In an ECP process, an acidic copper electroplating bath solution typically includes various additives such as suppressors, accelerators and levelers. In order to meet 65-nm technology gap fill requirements, the additive concentrations are selected to achieve rapid bottom-up fill optimization in high aspect ratio vias and trenches, as well as microscopic and macroscopic uniformity. Consequently, excessive post-ECP copper overburden is common, particularly in the fabrication of dense circuit patterns on wafers. Because excessive copper overburden provides a significant source of metal particles generated during the CMP process, defects are often induced in device structures during the fabrication steps carried out after CMP. Accordingly, novel ECP polymer additives for an ECP solution are needed to reduce the copper overburden generated during an ECP process while optimizing ECP gap fill capability.

An object of the present invention is to provide novel polymer additives which are capable of reducing overburden of a metal electroplated on a substrate.

Another object of the present invention is to provide novel ECP (electrochemical plating) polymer additives which are capable of reducing overburden and optimizing gap fill capability in the electrochemical plating of copper or other metal on a substrate.

Still another object of the present invention is to provide novel ECP polymer additives which are effective in reducing the formation of defects in devices fabricated on a substrate by reducing overburden in the electrochemical plating of a metal onto the substrate.

Yet another object of the present invention is to provide novel polymer additives which can be added to an electroplating bath solution to substantially reduce the formation of surface defects in an electroplated metal while optimizing gap fill capability.

A still further object of the present invention is to provide novel ECP polymer additives which include low cationic charge density polymers.

A still further object of the present invention is to provide a novel method for reducing metal overburden in the electrochemical plating of a metal onto a substrate, which method includes providing an electroplating bath solution, adding a low cationic charge density polymer additive to the solution and electroplating the metal onto the substrate in the solution.

SUMMARY OF THE INVENTION

In accordance with these and other objects and advantages, the present invention is generally directed to novel ECP polymer additives and a method which are suitable to reduce the formation of metal overburden in the electroplating of a metal while optimizing gap fill capability. Reducing the overburden on an electroplating metal reduces the quantity of metal particles generated during the subsequent chemical mechanical planarization step. Consequently, structural defects in the devices fabricated on the wafer are reduced. The polymer additives of the invention include low cationic charge density polymers which are added to the electroplating bath solution prior to the ECP process.

The polymer additives may include low cationic charge density copolymers having aromatic and amine functional group monomers. Preferably, the low cationic charge density polymers include benzene aromatic functional group monomers, such as benzene or pyrollidone and aromatic amine functional group monomers, such as imidazole or imidazole derivative. Preferably, the low cationic charge density polymers have a cationic charge density of typically about 1~6 meq/g and a molecular weight of typically about 2,000~1,000,000. Most preferably, the polymers have a molecular weight of typically about 10,000.

The method of the present invention includes providing an electroplating bath solution and providing low cationic charge density polymers in the solution. The substrate is immersed in the solution and subjected to electrochemical plating. The polymer additives reduce overburden of the electroplated metal on the substrate while optimizing gap fill capability.

BRIEF DESCRIPTION OF THE DRAWINGS

The invention will be better understood, by way of example, with reference to the accompanying drawings, in which.

DETAILED DESCRIPTION OF THE INVENTION

Figure 1:
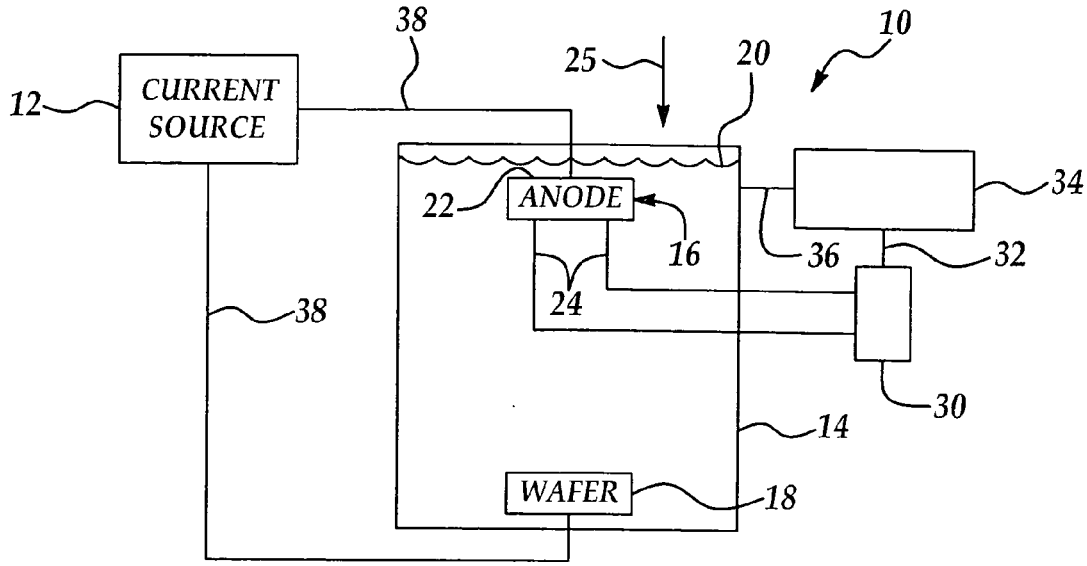
FIG. 1 is a schematic of an electrochemical plating system in implementation of the present invention.

The present invention contemplates novel ECP polymer additives which reduce metal overburden in an electroplated metal while optimizing gap fill capability. Reducing the overburden on an electroplating metal reduces the quantity of metal particles generated during the subsequent chemical mechanical planarization step. Consequently, structural defects in the devices fabricated on the wafer are reduced. The polymer additives may include low cationic charge density co-polymers having aromatic and amine functional group monomers. Preferably, the low cationic charge density polymers include aromatic-functional group monomers, such as benzene or pyrollidone, aromatic amine functional group monomers, such as imidazole or imidazole derivative.

The method of the present invention includes providing an electroplating bath solution and providing low cationic charge density polymer additives in the solution. The substrate is immersed in the solution and subjected to electrochemical plating. The polymer additives reduce overburden of the electroplated metal on the substrate while optimizing gap fill capability.

It has been found that the polymer additives and method of the present invention are capable of reducing copper overburden on the order of about 3,000 angstroms, without degrading gap fill performance. Due to the low charge density of the polymer additives, the additives do not strongly interfere with the absorption behavior of other electroplating additives during critical periods of bottom-up gap fill, even at high polymer concentrations. Furthermore, ECP hump height reduction can be accomplished by mass transfer effects at high polymer additive concentrations.

In a most preferred embodiment of the present invention, the low cationic charge density polymer additives have the chemical formula: $CH_3(CH_2CHX)_m(CH_2CHYCH_2)_nCH_3$, where X is an aromatic functional group, preferably benzene or pyrollidone; Y is an amine functional group, preferably imidazole or an imidazole derivative; and m and n are integers which indicate the number of aromatic (X) monomers and the number of amine (Y) monomers, respectively, in each polymer. Table I (below) shows the weight percentages of (X) monomer and (Y) monomer in each of multiple low cationic charge density polymers, the molecular weight of each polymer, and the charge density in milliequivalents per gram (meq/g) of each polymer:

TABLE I

| Polymer | X (wt %) | Y (wt %) | M.W. | Charge Density (meq/g) |
|---|---|---|---|---|
| L-410 | 40 | 10 | 700,000 | 0.5 |
| L-820 | 80 | 20 | 1,000,000 | 1.09 |
| L-550 | 55 | 45 | 400,000 | 3 |
| L-905 | 5 | 95 | 40,000 | 6.1 |

The polymer charge density affects such electroplating parameters as suppression, adhesion and surface mobility of the polymer in the electroplating bath solution. The molecular weight of each polymer reflects the number of (X) monomers and (Y) monomers in each polymer and determines mass transfer of the polymers in the electroplating bath solution. Preferably, the polymers have a cationic charge density of typically about 1~6 meq/g and a molecular weight of typically about 2,000~400,000. Most preferably, the polymers have a molecular weight of typically about 10,000.

It will be appreciated from a consideration of Table I that each of the polymers L-820, L-550 and L-905 has a charge density which falls within the range of about 1~6 meq/g and a molecular weight which falls within the range of about 40,000 to about 1,000,000. However, the polymers L-550 and L-905 fall within the preferred molecular weight range of about 2,000~400,000. Accordingly, polymers having the molecular characteristics of L-550 and L-905 produce optimum effects for purposes of the present invention.

The polymer additives and method of the present invention may be used with any formulation for the electroplating bath solution, such as copper, aluminum, nickel, chromium, zinc, tin, gold, silver, lead and cadmium electroplating baths. The present invention is also suitable for use with electroplating baths containing mixtures of metals to be plated onto a substrate. It is preferred that the electroplating bath be a copper alloy electroplating bath, and more preferably, a copper electroplating bath.

Typical copper electroplating bath formulations are well known to those skilled in the art and include, but are not limited to, an electrolyte and one or more sources of copper ions. Suitable electrolytes include, but are not limited to, sulfuric acid, acetic acid, fluoroboric acid, methane sulfonic acid, ethane sulfonic acid, trifluormethane sulfonic acid, phenyl sulfonic acid, methyl sulfonic acid, p-toluenesulfonic acid, hydrochloric acid, phosphoric acid and the like. The acids are typically present in the bath in a concentration in the range of from about 1 to about 300 g/L. The acids may further include a source of halide ions such as chloride ions.

Suitable sources of copper ions include, but are not limited to, copper sulfate, copper chloride, copper acetate, copper nitrate, copper fluoroborate, copper methane sulfonate, copper phenyl sulfonate and copper p-toluene sulfonate. Such copper ion sources are typically present in a concentration in the range of from about 10 to about 300 g/L of electroplating solution. In a preferred embodiment, the cationicily charged polymer additives of the present invention are present in the electroplating bath solution in a concentration of from typically about 5 ppm to about 100 ppm. An accelerator is typically present in the electrolyte bath solution in a concentration of from typically about 5 ppm to about 40 ppm. the accelerator may be any type of commercially-available accelerator known by those skilled in the art for accelerating a metal electroplating deposition process.

Other electrochemical plating process conditions suitable for implementation of the present invention include a plating rpm of from typically about 0 rpm to about 500 rpm; a plating current of from typically about 0.2 $mA/cm^2$ to about 20 $mA/cm^2$; and a bath temperature of from typically about 10 degrees C. to about 35 degrees C.

Referring to FIG. 1, an electrochemical plating (ECP) system 10 suitable for implementation of the present invention is shown. The system 10 may be conventional and includes a standard electroplating cell having an adjustable current source 12, a bath container 14, a typically copper anode 16 and a cathode 18, which cathode 18 is the semiconductor wafer substrate that is to be electroplated with copper. The anode 16 and cathode/substrate 18 are connected to the current source 12 by means of suitable wiring 38. The bath container 14 holds an electrolyte electroplating bath solution 20. The system 10 may further include a mechanism for rotating the substrate 18 in the bath 20 during the electroplating process, as is known by those skilled in the art.

The ECP system 10 may further include a pair of bypass filter conduits 24, a bypass pump/filter 30, and an electrolyte holding tank 34 for the introduction of additional electrolytes into the bath container 14, as necessary. The bypass filter conduits 24 typically extend through the anode 16 and open to the upper, oxidizing surface 22 of the anode 16 at opposite ends of the anode 16. The bypass filter conduits 24 connect to the bypass pump/filter 30 located outside the bath container 14, and the bypass pump/filter 30 is further connected to the electrolyte holding tank 34 through a tank inlet line 32. The electrolyte holding tank 34 is, in turn, connected to the bath container 14 through a tank outlet line 36. It is understood that the ECP system 10 heretofore described represents just one example of a possible system which is suitable for implementation of the present invention, and other systems of alternative design may be used instead.

Figure 1A:
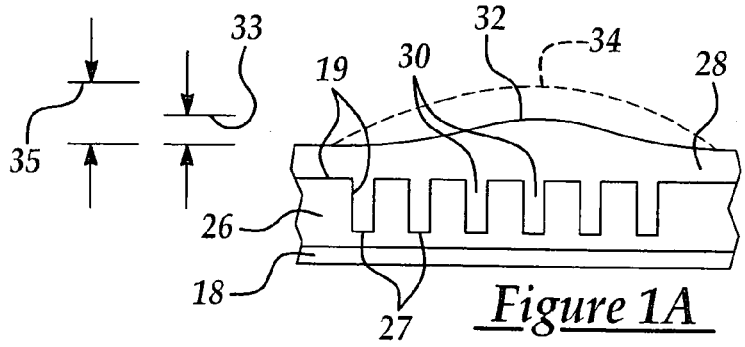
FIG. 1A is a cross-sectional view of a substrate with a metal layer electroplated thereon using an electroplating bath provided with the ECP polymer additives of the present invention, illustrating a reduction in metal overburden on the metal layer.
Figure 2:
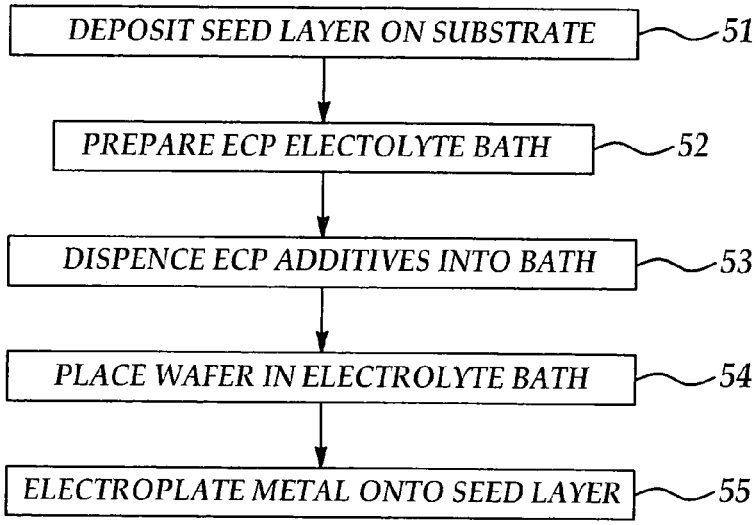
FIG. 2 is a flow diagram illustrating a typical flow of process steps according to the method of the present invention.

Referring to FIGS. 1, 1A and 2, according to the method of the present invention, a wafer substrate 18 is provided having a dielectric layer 26 deposited thereon; multiple trenches 27 etched in the dielectric layer 26; and a metal seed layer 19, such as copper, deposited on the sidewalls and bottom of each trench 27, as shown in FIG. 1A. An electrochemical plating process, which will be hereinafter described, is used to electroplate a copper or other metal layer 28 onto the seed layer 19 to form metal lines 30 in the respective trenches 27. An electroplating process carried out according to the present invention to form the metal layer 28 results in formation of an overburden hump 32 having a hump height 33 which is substantially less than the hump height 35 of an overburden hump 34 that is formed as a result of a conventional electrochemical plating bath and method.

As shown, in step 51 of FIG. 2, after the trenches 27 are etched in the dielectric layer 26, the metal seed layer 19 is deposited on the sidewalls and bottom of the trenches 27. The seed layer 19 may be formed using conventional chemical vapor deposition (CVD) or physical vapor deposition (PVP) techniques, according to the knowledge of those skilled in the art. The seed layer 19 has a thickness of typically about 50–1500 angstroms.

As indicated in step 52 of FIG. 2, the electrochemical plating (ECP) electrolyte bath solution 20 is prepared in the bath container 14. The electroplating bath solution 20 typically includes an accelerator additive having a concentration of from typically about 8 ppm to about 40 ppm, as heretofore noted. Next, as indicated in step 53 and shown in FIG. 1, cationic charged polymer additives 25 of the present invention are added to and throughly mixed with the electroplating bath solution 20 to achieve a polymer additive concentration of from typically about 5 ppm to about 100 ppm. The anode 16 and wafer/substrate 18 are then immersed in the bath solution 20 and connected to the adjustable current source 12 typically through wiring 38.

As indicated in step 54 of FIG. 2, the cathode/substrate 18 is immersed in the bath solution 20. Accordingly, the seed layer 19 on the substrate 18 contacts the bath solution 20. Due to mass transfer of the polymer additive 25 in the electrolyte bath solution 20, substantially the entire surface of the seed layer 19 is contacted by the polymer additive 25.

As shown in FIG. 1A and indicated in step 55 of FIG. 2, the metal layer 28 is electroplated onto the seed layer 19, typically as follows. The electroplating bath solution 20 is heated to a temperature of typically from about 10 degrees C. to about 35 degrees C. In operation of the ECP system 10, the current source 12 applies a selected voltage potential between the anode 16 and the cathode/substrate 18. This voltage potential creates a magnetic field around the anode 16 and the cathode/substrate 18, which magnetic field affects the distribution of the copper ions in the bath solution 20.

In a typical copper electroplating application, a voltage potential of about 2 volts may be applied for about 2 minutes, and a plating current of from typically about 0.2 $mA/cm^2$ to about 60 $mA/cm^2$ flows between the anode 16 and the cathode/substrate 18. The plating rpm for the substrate 18 is typically about 0–500 rpm. Consequently, copper is oxidized typically at the oxidizing surface 22 of the anode 16 as electrons from the copper anode 16 reduce the ionic copper in the copper sulfate solution bath 20 to form a copper electroplate (not illustrated) at the interface between the cathode/substrate 18 and the copper sulfate bath 20. The electroplating solution is carried out for a period of typically about 100 sec to deposit the metal layer 28 on the dielectric layer 26.

Due to the presence of the polymer additive 25 in the electrolyte bath solution 20, the electroplated metal layer 28 deposited onto the seed layer 19 includes an overburden hump 28 having a hump height 33 of typically less than about 2,000 angstroms. This is compared to an overburden hump 34 that results from a conventional electroplating process, which overburden hump 34 may have a hump height 35 of typically 6,500 angstroms or greater.

Furthermore, the electroplated metal layer 28 is particularly effective in high aspect ratio gap-filling applications. Accordingly, the electroplated metal layer 21 on the substrate 18 contributes to the fabrication of high-quality IC devices that are characterized by high structural and operational integrity. Moreover, during the subsequent chemical mechanical planarization (CMP) step which is carried out to smooth or planarize the overburden hump 32, the formation of potential defect-forming CMP particles is minimized due to the reduced size of the overburden hump 34.

While the preferred embodiments of the invention have been described above, it will be recognized and understood that various modifications can be made in the invention and the appended claims are intended to cover all such modifications which may fall within the spirit and scope of the invention.

What is claimed is:

1. An electrochemical plating electrolyte solution, comprising:

an electrolyte bath solution; and a polymer additive provided in said electrolyte bath solution, said polymer additive comprising polymers having a chemical formula of $CH_3(CH_2CHX)_m(CH_2CHYCH_2)_nCH_3$, where X is an aromatic functional group; Y is an aromatic amine functional group; and m and n are integers indicating numbers of an aromatic monomer and an aromatic amine monomer, respectively, in said each of said polymers.

2. The electrochemical plating electrolyte solution of claim 1 wherein said aromatic monomer comprises said aromatic functional group selected from the group consisting of benzene and pyrrolidone.

3. The electrochemical plating electrolyte solution of claim 1 wherein said aromatic amine monomer comprises said aromatic amine functional group selected from the group consisting of imidazole and an imidazole derivative.

4. The electrochemical plating electrolyte solution of claim 3 wherein said aromatic monomer comprises said aromatic functional group selected from the group consisting of benzene and pyrrolidone.

5. The electrochemical plating electrolyte solution of claim 1 wherein said aromatic functional group comprises a functional group selected from the group consisting of benzene and pyrrolidone.

6. The electrochemical plating electrolyte solution of claim 1 wherein said aromatic amine functional group comprises a functional group selected from the group consisting of imidazole and an imidazole derivative.

7. The electrochemical plating electrolyte solution of claim 6 wherein said aromatic functional group comprises a functional group selected from the group consisting of benzene and pyrrolidone.

8. An electrochemical plating electrolyte solution, comprising:

an electrolyte bath solution; and a polymer additive provided in said electrolyte bath solution, said polymer additive comprising polymers having a chemical formula of $CH_3(CH_2CHX)_m(CH_2CHYCH_2)_nCH_3$, where X is an aromatic functional group; Y is an aromatic amine functional group; and m and n are integers indicating numbers of an aromatic monomer and an aromatic amine monomer, respectively, in said each of said polymers; and a cationic charge density of from about 1 meq/g to about 6 meq/g.

9. The electrochemical plating electrolyte solution of claim 8 wherein said aromatic monomer comprises said aromatic functional group selected from the group consisting of benzene and pyrrolidone.

10. The electrochemical plating electrolyte solution of claim 8 wherein said aromatic amine monomer comprises said aromatic amine functional group selected from the group consisting of imidazole and an imidazole derivative.

11. The electrochemical plating electrolyte solution of claim 8 wherein each of said polymers has a molecular weight of from about 2,000 to about 400,000.

12. The electroplating electrolyte solution of claim 11 wherein said aromatic monomer comprises said aromatic functional group selected from the group consisting of benzene and pyrrolidone.

13. The electroplating electrolyte solution of claim 11 wherein said aromatic amine monomer comprises said aromatic amine functional group selected from the group consisting of imidazole and an imidazole derivative.

14. A method of electroplating a metal on an electroplating surface, comprising the steps of:

providing an electrolyte bath solution;

mixing a polymer additive with said electrolyte bath solution, said polymer additive comprising polymers having a chemical formula of $CH_3(CH_2CHX)_m(CH_2CHYCH_2)_nCH_3$, where X is an aromatic functional group; Y is an aromatic amine functional group; and m and n are integers indicating numbers of an aromatic monomer and an aromatic amine monomer, respectively, in said each of said polymers;

immersing said electroplating surface in said electrolyte bath solution; and electroplating said metal onto said electroplating surface.

15. The method of claim 14 wherein said aromatic monomer comprises said aromatic functional group selected from the group consisting of benzene and pyrrolidone and said aromatic amine monomer comprises said aromatic amine functional group selected from the group consisting of imidazole and an imidazole derivative.

16. The method of claim 14 wherein each of said polymers has a molecular weight of from about 2,000 to about 400,000 and a cationic charge density of from about 1 meq/g to about 6 meq/g.

* * * * *